US005458503A

United States Patent [19]

Below

[11] Patent Number: 5,458,503

[45] Date of Patent: Oct. 17, 1995

[54] SNAP LOCKING MOUNTING SCHEME FOR SECURING WIRE CONNECTORS

[75] Inventor: Randall J. Below, Woodbury, Conn.

[73] Assignee: The Siemon Company, Watertown, Conn.

[21] Appl. No.: 796,053

[22] Filed: Nov. 20, 1991

[51] Int. Cl.[6] ..... H01R 4/24

[52] U.S. Cl. ..... 439/404; 439/536; 439/701; 439/725

[58] Field of Search ..... 439/707–725, 439/402, 403, 404, 452, 460, 536, 701

[56] References Cited

U.S. PATENT DOCUMENTS

| | | | |
|---|---|---|---|
| 3,798,587 | 3/1974 | Ellis, Jr. et al. | 439/403 |
| 4,655,529 | 4/1987 | Yokoyama | 439/712 |
| 4,964,812 | 10/1990 | Siemon et al. | 439/403 |
| 5,044,979 | 9/1991 | Siemon et al. | 439/724 |

OTHER PUBLICATIONS

Mod–Tap Components Catalog 1991.
Ortronics Voice & Data Booklet.

*Primary Examiner*—David L. Pirlot
*Attorney, Agent, or Firm*—Fishman, Dionne & Cantor

[57] ABSTRACT

A snap locking mounting scheme for securing wire connectors is presented. In accordance with the connector mounting scheme, a wire termination assembly is removably secured in a mounting base by a snap locking mechanism. The wire termination assembly includes a mounting strip which is connected to a wire termination block at one end and is snap locked into the mounting base at the other end. The termination assembly further including an interconnecting device (e.g., telecommunication modular jack) connected to the termination block by a plurality of wires.

5 Claims, 13 Drawing Sheets

SNAP LOCKING MOUNTING SCHEME FOR SECURING WIRE CONNECTORS

CROSS-REFERENCE TO RELATED APPLICATIONS

A related U.S. application entitled Panel Yoke And Snap Locking Mounting Scheme For Securing Wire Connectors invented by Randall J. Below (Attorney Docket No. 91-1264) is filed contemporaneously herewith.

BACKGROUND OF THE INVENTION

This invention relates to a mounting scheme for use with telecommunication devices. More particularly, this invention relates to a snap locking mounting scheme for securing wire connectors or the like.

Wire connector schemes are well known in the telecommunication art. Wire termination blocks (or wire connection blocks) are one such well known commercially available connector scheme. For example, such a termination block is described in U.S. Pat. No. 4,964,812 which is assigned to the assignee hereof and fully incorporated herein by reference.

The termination block of U.S. Pat. No. 4,964,812 comprises a housing which includes a plurality of spaced apart teeth along the length of its upper surface. The teeth are alternated and staggered in height to facilitate indexing of wire conductors in wire strain relief slots. Also, as is conventional with connecting blocks of this type, the teeth include tapered sides to facilitate entry of the wire conductors.

The lower portion of the termination block includes a cavity formed by two depending sides of the housing. Within the cavity and spaced between the upper and lower surfaces of the housing is a floor having a plurality of rectangular openings therethrough. The openings are sized to receive and position individual beam contacts. The spaced openings continue through the upper portion of the housing through the staggered teeth to form opposed channels for receiving and guiding the beam contacts during assembly.

The lower edges of the sides of the housing of the termination block have an opening for engaging semispherical protrusions on a separable wiring block for fixedly attaching the termination block to the wiring block.

Like the termination block, the wiring block has a plurality of spaced apart teeth along the length of its upper surface. The teeth are alternated in height and include tapered sides to facilitate interconnection of the teeth and the beam contacts from the termination block. The wiring block has a row of rectangular openings for accepting the beam contacts. The wiring block is generally permanently affixed to a surface.

The termination block must be easily and quickly disconnected from the wiring block when replacement or repair is required. This is desirable since a wire in one of the beam contacts may become loose and lose electrical contact. While the termination block/wiring block of U.S. Pat. 4,964,812 is well suited for its intended purposes, there is a perceived need for an improved interconnection structure for mechanically interconnecting such a termination block to a mating wiring block. Because this connection is often made in the field, care must be taken to avoid damaging the contacts located in both blocks.

SUMMARY OF THE INVENTION

The above-discussed and other drawbacks and deficiencies of the prior art are overcome or alleviated by the connector mounting scheme of the present invention. In accordance with the present invention, this mounting scheme comprises a wire termination assembly which is secured in a mounting base by snap locking means. The wire termination assembly includes a mounting strip which is connected to a wire termination block at one end and is adapted to be snap locked into the mounting base at the other end. The termination assembly may also include a modular jack connected to the termination block by a plurality of wires.

The mounting base may be attached to a desired surface in a variety of fashions. For example, the mounting base may have a double sided tape affixed to its lower surface to provide a means for securing the base to a surface (e.g., a surface of a cover plate). Alternatively, the mounting base may be incorporated (e.g. molded) into a surface of a cover plate. Such a cover plate may include an aperture for providing access to a modular jack secured thereto. Multiple modular jack configurations are disclosed, such as, dual modular jack cover plates, side-by-side dual modular jack cover plates and quad modular jack cover plates. Each of the above-mentioned cover plates incorporates a corresponding number of mounting bases and wire termination assemblies.

In accordance with the present invention, the snap lock interconnection feature of the mounting base and the mounting strip provides a secure removable connector mounting scheme for use with telecommunication devices (e.g., modular jacks). It will be appreciated that these modular jacks are also commonly used for data communications. The mounting strip preferably incorporates the features of the prior art wiring blocks of U.S. Pat. 4,964,812. However, the present invention improves upon the prior art by adding the snap locking feature in conjunction with the mounting base, to allow the wire termination block to be easily and quickly removably secured. The present invention allows installation and repair in the field without exposing the contacts which may adversely result in intermittent or open electrical connection.

The above-discussed and ocher features and advantages of the present invention will be appreciated and understood by those skilled in the art from the following detailed description and drawings.

BRIEF DESCRIPTION OF THE DRAWINGS

Referring now to the drawings wherein like elements are numbered alike in the several FIGURES:

FIGS. 2A–D are views of the mounting base of FIG. 1 wherein FIG. 2A is a top view thereof, FIG. 2B is a view along the line 2B—2B of FIG. 2A, FIG. 2C is a side elevational view thereof, and FIG. 2D is an end view thereof;

FIGS. 3A–D are views of the mounting strip of FIG. 1 wherein FIG. 3A is a side elevational view thereof, FIG. 3B is a top view thereof, FIG. 3C is a bottom view thereof, and FIG. 3D is an end view thereof;

FIGS. 5A–C are views of the wire termination assembly of FIG. 1 wherein FIG. 5A is a bottom view thereof, FIG. 5B is an end view thereof, and FIG. 5C is a top view thereof;

FIGS. 7A–D are views of a dual modular jack cover plate having corresponding mounting bases with one wire termination assembly installed therein in accordance with the present invention wherein FIG. 7A is a front view thereof, FIG. 7B is a side elevational view thereof, FIG. 7C is a rear view thereof, and FIG. 7D is a view taken along the line 7D—7D in FIG. 7C;

FIGS. 8A–D are views of the cover plate of FIGS. 7A–D with two wire termination assemblies installed therein wherein FIG. 8A is a front view thereof, FIG. 8B is a side elevational view thereof, FIG. 8C is a rear view thereof, and FIG. 8D is an end view thereof;

FIGS. 9A–C are views of a dual side-by-side modular jack cover plate having corresponding mounting bases in accordance with the present invention wherein FIG. 9A is a front view thereof, FIG. 9B is a side elevational view thereof, and FIG. 9C is a rear view thereof;

FIGS. 10A–D are views of a quad modular jack cover plate assembly having corresponding mounting bases and with four wire termination assemblies installed therein wherein FIG. 10A is a front view thereof, FIG. 10B is side elevational view thereof, FIG. 10C is a rear view thereof, and FIG. 10D is an end view thereof;

FIGS. 11A–D are views of a dual modular jack assembly for use in the cover plate assembly of FIGS. 10A–D wherein FIG. 11A is front view thereof, FIG. 11B is a side elevational view thereof and includes a rear cover in accordance with the present invention, FIG. 11C is a rear view thereof, and FIG. 11D is an end view thereof;

FIGS. 12A–G are views of a dual panel yoke for use in the jack assembly of FIGS. 11A–D wherein FIG. 12A is rear view thereof, FIG. 12B is a side elevational view thereof, FIG. 12C is a first end view thereof, FIG. 12D is a front view thereof, FIG. 12E is a view taken along the line 12E—12E in FIG. 12A, FIG. 12F is a view taken along the line 12F—12F in FIG. 12D, and FIGURE 12G is a second end view thereof;

FIGS. 13A and B are views of a cover plate for use in the cover plate assembly of FIGS. 10A–D wherein FIG. 13A is a front view thereof.

FIGS. 14A–D are views of an insert for use with the dual panel yoke of FIGS. 12A–F wherein FIG. 14A is a top view thereof, FIG. 14B is a bottom view thereof, FIG. 14C is an end view thereof, and FIG. 14D is a side elevational view thereof;

FIGS. 15A–D are views of a rear cover for use with the dual modular jack assembly of FIGS. 11A–D wherein FIG. 15A is a top view thereof, FIG. 15B is a side elevational view thereof, FIG. 15C is an end view thereof, and FIG. 15D is a bottom view thereof;

DESCRIPTION OF THE PREFERRED EMBODIMENT

Figure 1:
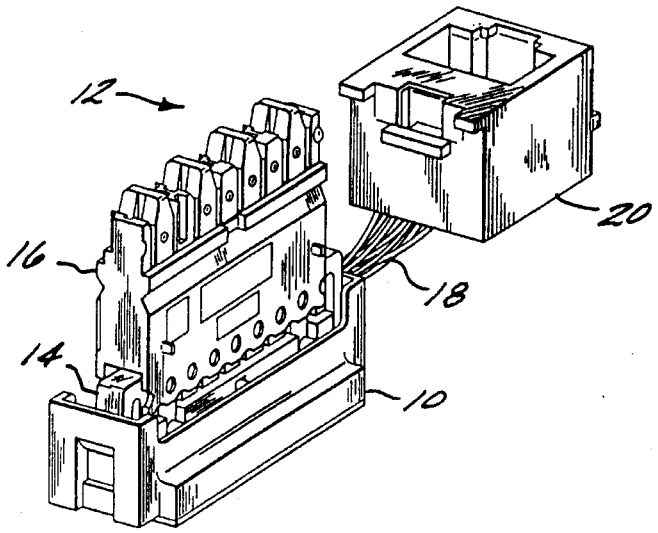
FIG. 1 is a perspective view of a wire termination assembly including a mounting strip connected to a mounting base in accordance with the present invention.
Figure 2A:
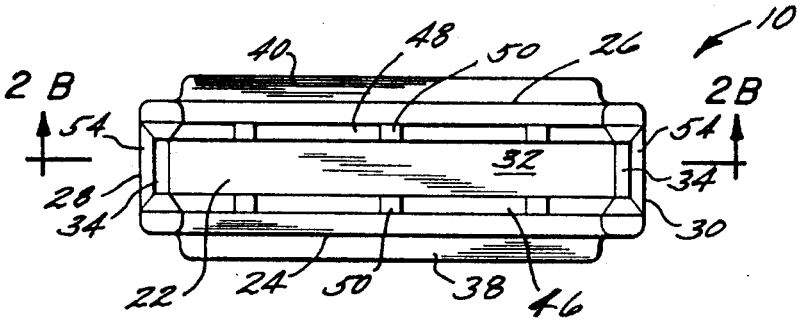
Figure 2B:
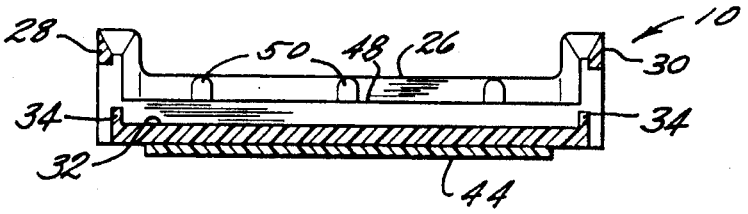
Figure 2C:
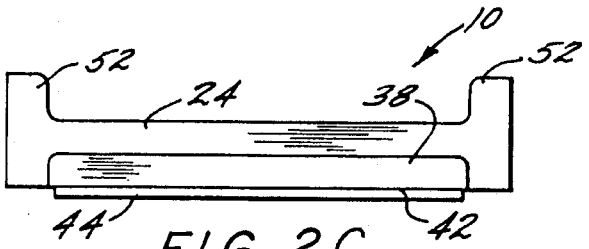
Figure 2D:
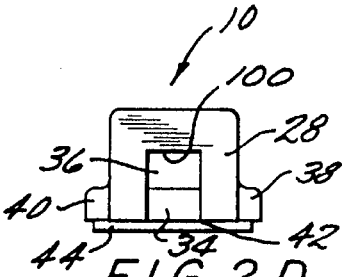
Figure 3B:
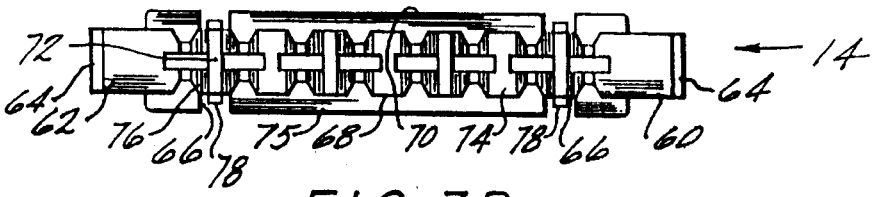
Figure 3A:
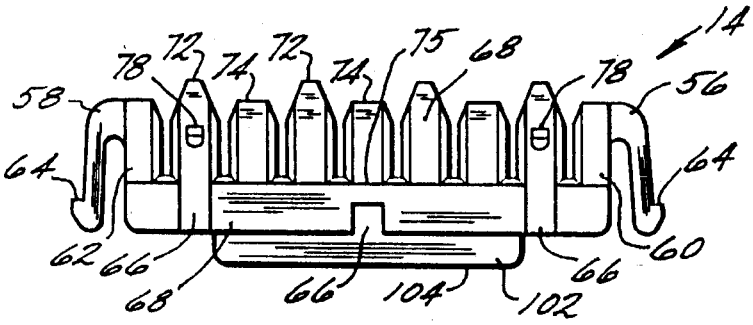
Figure 3D:
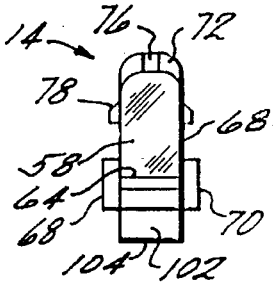
Figure 3C:
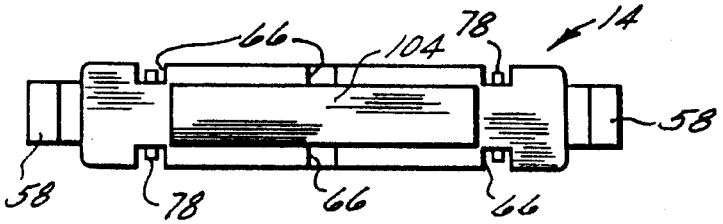
Figure 5C:
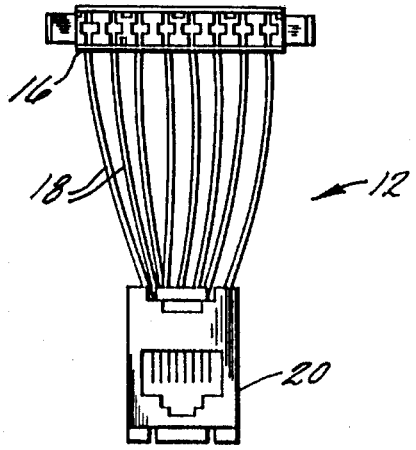
Figure 5B:
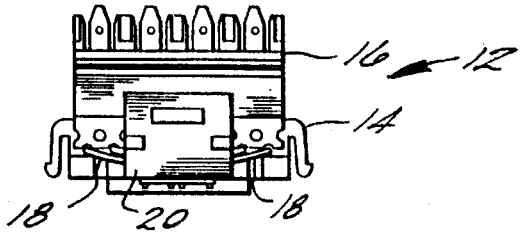
Figure 5A:
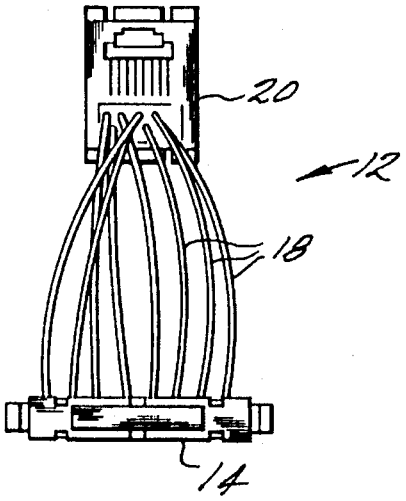

Referring to FIG. 1, a mounting base 10 in accordance with the present invention is shown connected to a wire termination assembly 12. Assembly 12 (see FIGS. 5A–C) includes a mounting strip 14 which is connected by a plurality of wire conductors 18 between the lower end of a termination block 16 (of the type disclosed in U.S. Pat. 4,964,812) and a modular jack 20. As will be described in detail below, mounting strip 14 is snap locked into mounting base 10.

Referring now to FIGS. 2A–D, mounting base 10 comprises means for snap locking mounting strip 14 therein and means for securing base 10 to a surface (described hereinafter). More particularly, base 10 has a channel 22 which is formed by opposed sides 24, 26, opposed ends 28, 30 and a lower portion 32. Each end 28, 30 has an inverted U-shape and together with a corresponding recessed member 34 define an aperture 36 at each end. Extending normally from the lower portion of each side 24, 26 is a corresponding ledge 38, 40. The lower surfaces of the ledges 38, 40 and the lower surface of portion 32 form a continuous planar surface 42. Attached to surface 42 is a known conventional double sided adhesive tape 44. Tape 44 provides a preferred means for mounting base 10 onto a surface. However, it will be appreciated that any other adhesive or mechanical attachment means may be used to attach mounting base 10 to a desired surface.

Each side 24, 26 has an interior ledge 46, 48 with three, spaced protruding elements 50 extending normally upwardly therefrom. Each side 24, 26 also has a tab 52 extending upwardly at each end. The upper interior surfaces 54 of ends 28, 30 are tapered inwardly to facilitate mating with mounting strip 14. It is preferred +that base 10 (with the exception of tape 44) be a single plastic molded piece, however it may be formed by other well know methods (e.g. machining a plastic block). Referring now to FIGS. 3A–D, mounting strip 14 has snap lock mounting means oppositely disposed at each end. The snap lock mounting means comprises a pair of resilient arms 56, 58 at each respective end 60, 62 of strip 14. Each arm 56, 58 extends outwardly and then downwardly from respective ends 60, 62 in a direction generally parallel to end surfaces 60, 62, as is clearly shown in FIG. 3A. The lower most portions of arms 56 and 58 include a latch which faces outwardly away from the mounting strip 14 and includes a retaining edge 64. Further, strip 14 has three channels 66 at the lower portion of each side 68 and 70 for receiving elements 50 of base 10.

Mounting strip 14 has a plurality of spaced apart teeth 72, 74 along the length of its upper surface 75. Teeth 72 and 74 alternate in height and include tapered sides to facilitate interconnection of the teeth 72, 74 and a row of beam contacts (described hereinafter) from block 16 having wires 18 disposed therein. Strip 14 also as a row of rectangular openings 76 for accepting the beam contacts. To detachably interlock terminal block 16 and mounting strip 14, a semi-spherical protrusion 78 on each side of the teeth 72 at each end of strip 14 and a corresponding plurality of openings in block 16 are provided.

Figure 4:
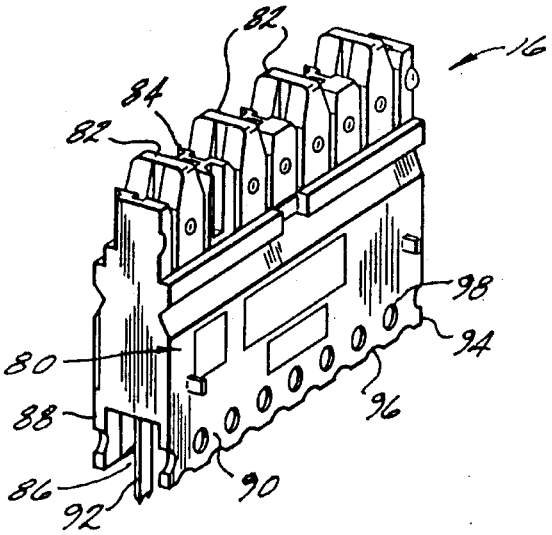
FIG. 4 is a perspective view of a wire termination block for use in the wire termination assembly of FIG. 1.

Referring to FIG. 4, wire termination block 16 is shown. Termination block 16 may be the wire termination block described in U.S. Pat. No. 4,964,812 or any other suitable termination block (e.g., AT&T Technologies series 110 connector systems). Termination block 16 comprises a one piece molded housing 80. Housing 80 is substantially rectangular in shape and includes a plurality of spaced apart teeth 82 and 84 along the length of its upper surface. Teeth 82 and 84 alternate and are staggered in height to facilitate indexing of a second set of conductors in wire strain relief slots. Also, as is conventional with connecting blocks of this type, the teeth include tapered sides to facilitate entry of the second set of wire conductors.

The lower portion of housing 80 includes a U-shaped cavity 86 formed by two depending sides 88 and 90 of housing 80. Within cavity 86 and spaced between the upper and lower surfaces of housing 80 is a planar molded floor having a plurality of rectangular openings therethrough. The openings are sized to receive and position individual beam contacts 92. The spaced openings continue through the upper portion of housing 80 through the staggered teeth 82, 84 to form opposed channels for receiving and guiding beam contacts 92 during assembly.

The lower edges 94 of sides 88 and 90 of housing 80 have a scalloped configuration comprised of spaced radii 96. Between each radius 96 is an opening 98 for engaging the semispherical protrusions 78 on mounting strip 14 for fixedly attaching block 16 to mounting strip 14.

Figure 6:
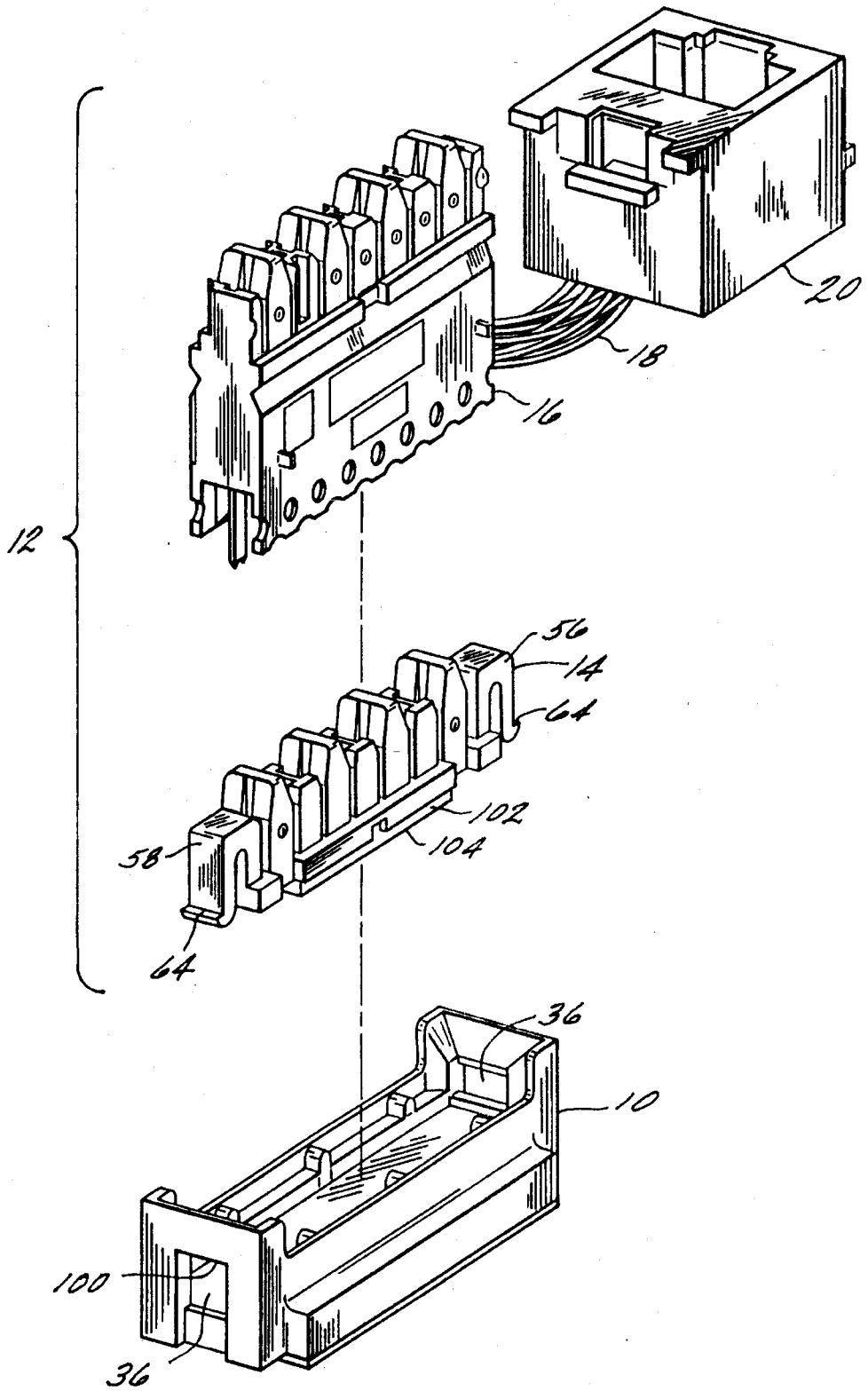
FIG. 6 is an exploded perspective view of FIG. 1.
Figure 7A:
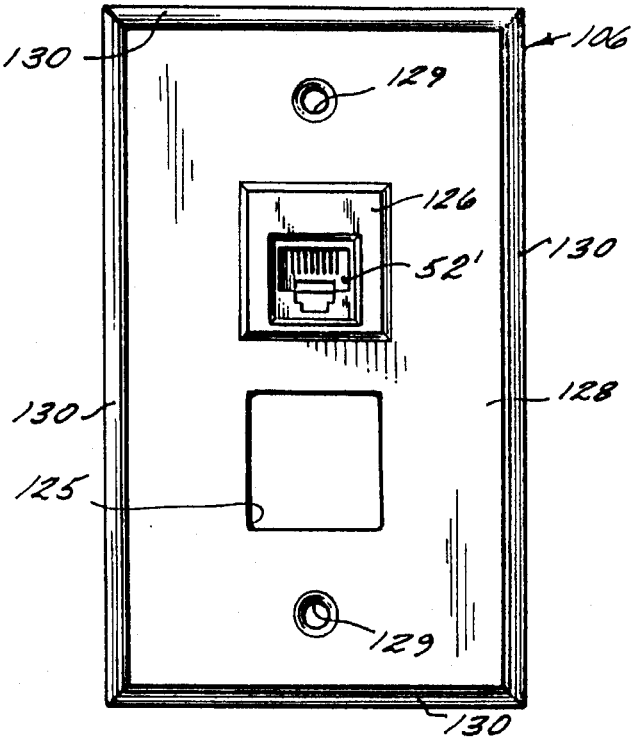
Figure 7B:
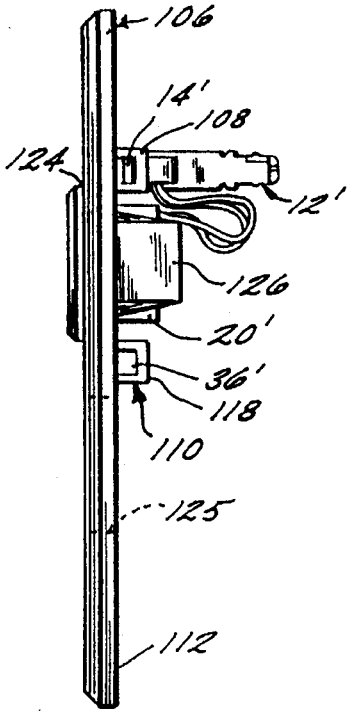
Figure 7C:
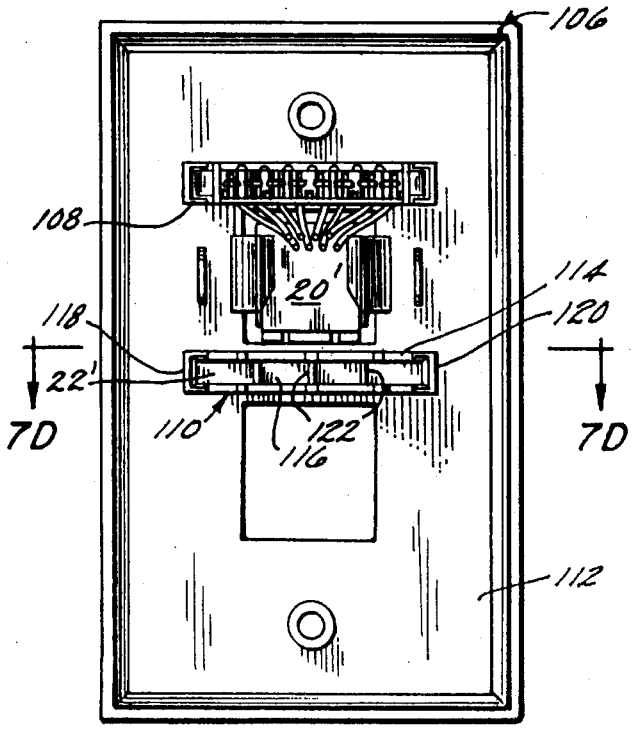
Figure 7D:
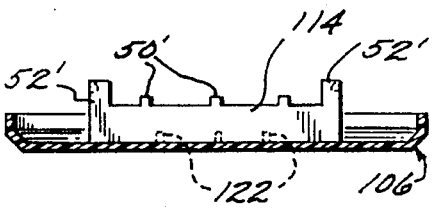
Figure 8A:
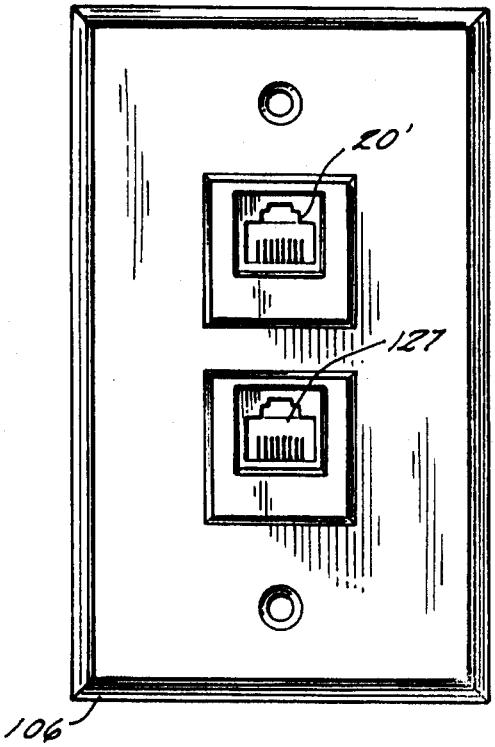
Figure 8B:
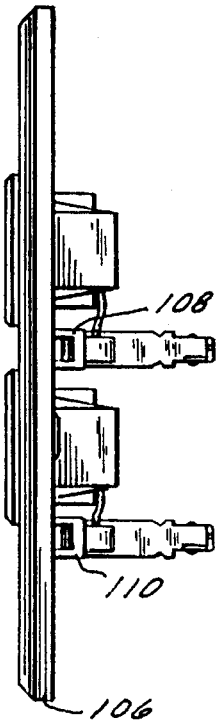
Figure 8C:
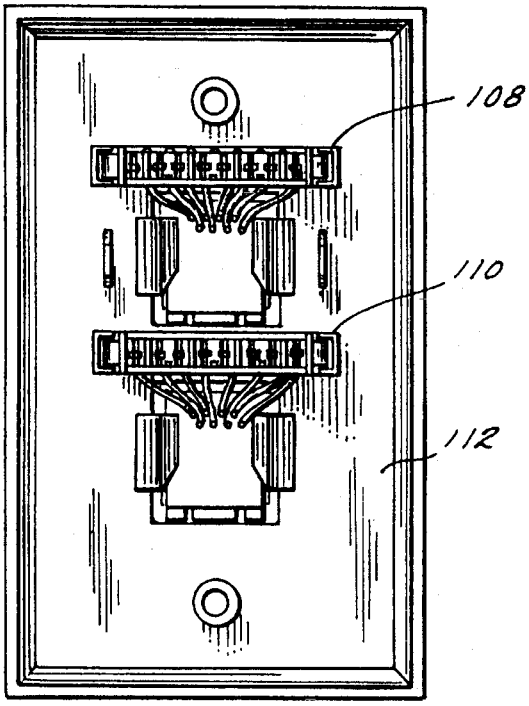
Figure 8D:
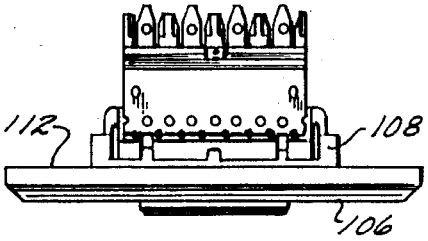
Figure 9A:
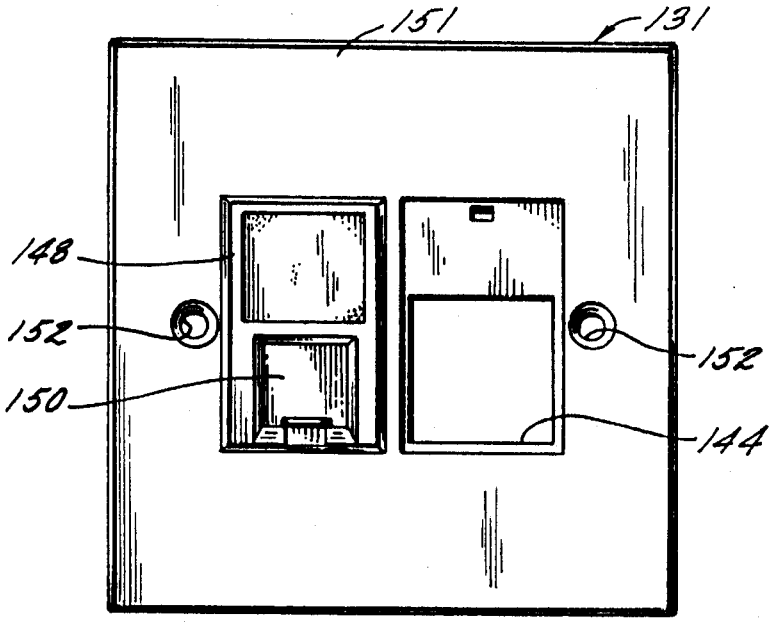
Figure 9B:
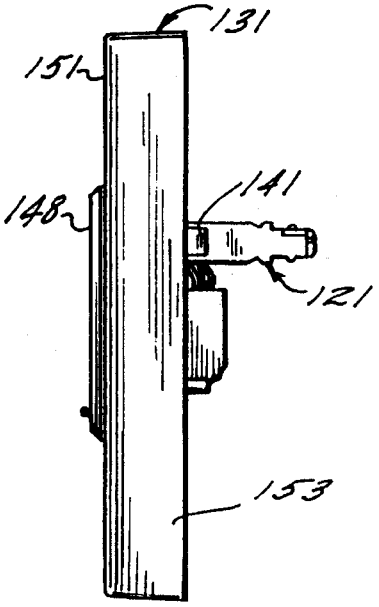
Figure 9C:
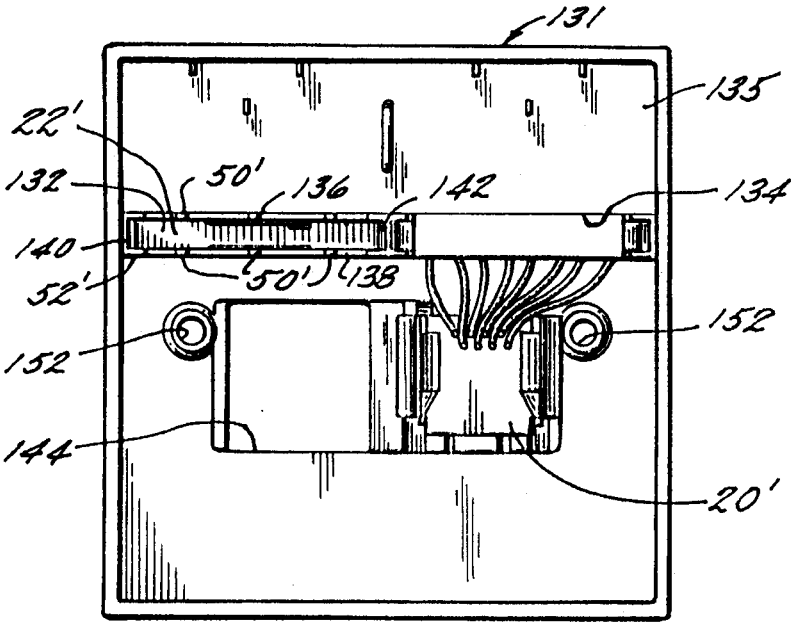
Figure 10A:
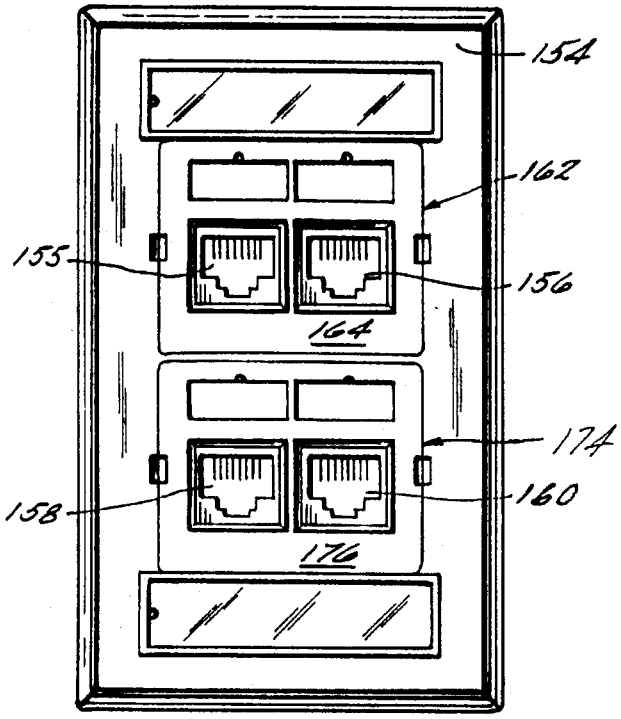
Figure 10B:
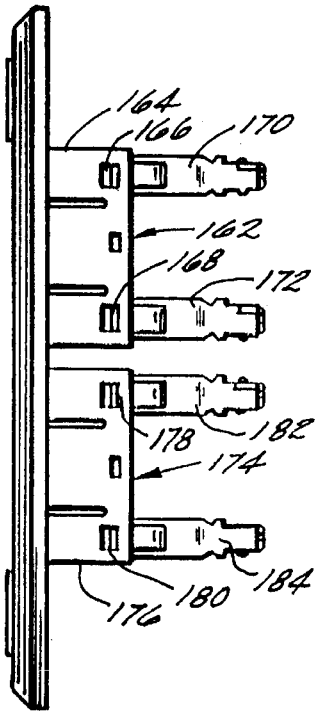
Figure 10C:
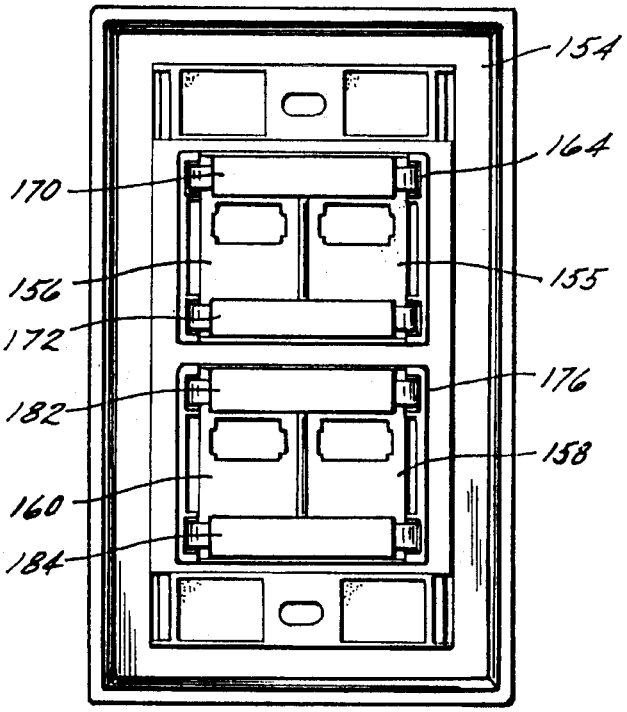
Figure 10D:
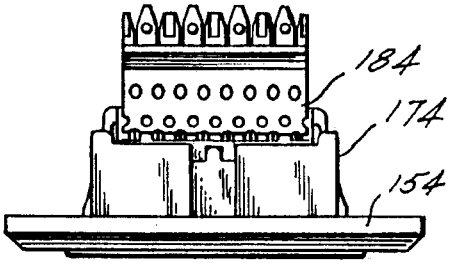
Figure 11A:
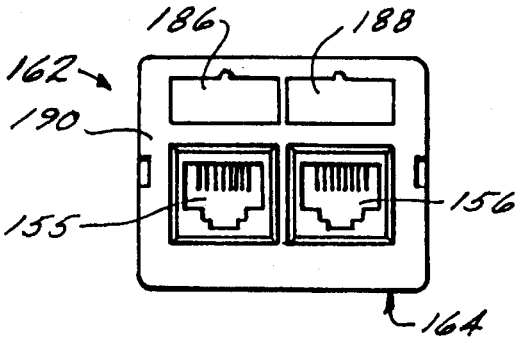
Figure 11B:
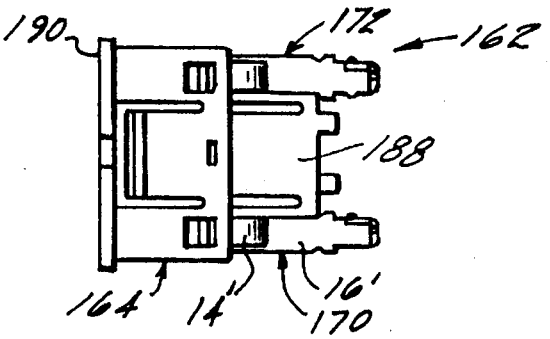
Figure 11C:
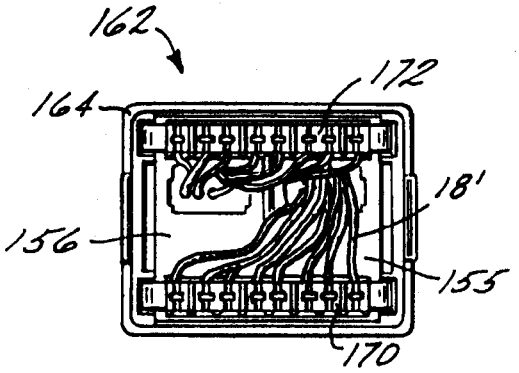
Figure 11D:
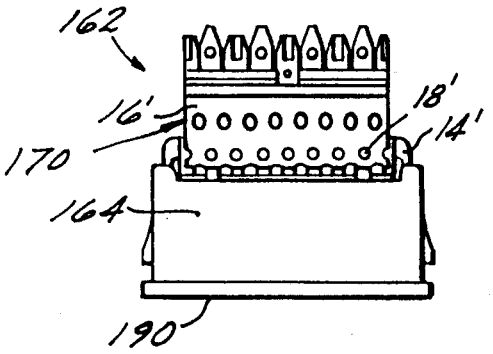
Figure 12E:
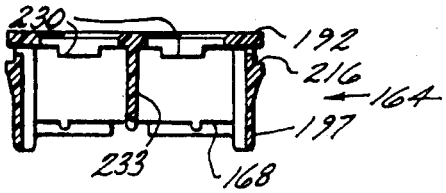
Figure 12G:
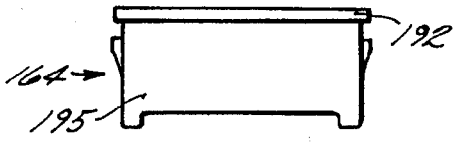
Figure 12A:
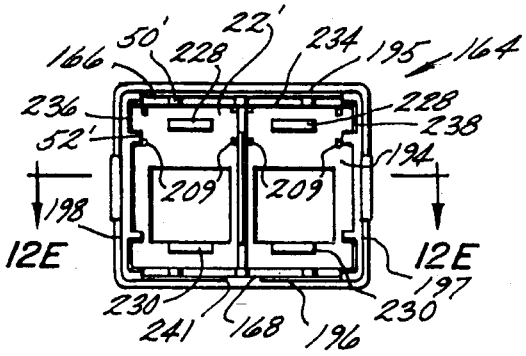
Figure 12F:
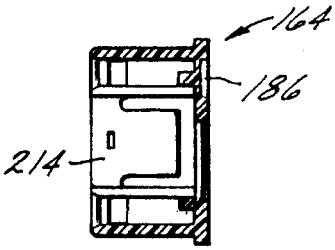
Figure 12D:
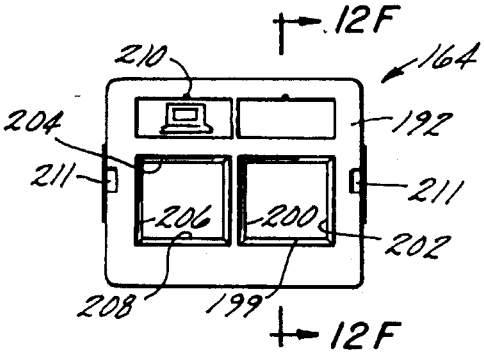
Figure 12B:
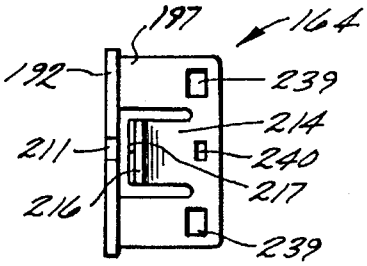
Figure 12C:
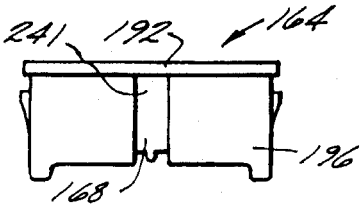

Referring primarily to FIG. 6 and also to FIGS. 3A–D, 4 and 5A–C, assembly 12 comprises mounting strip 14, termination block 16, wires 18 and an optional modular jack 20. When connecting mounting strip 14 to termination block 16, sides 88 and 90 of block 16 are urged outwardly by semispherical protrusions 78 of strip 14. Further, beam contacts 92 of block 16 are disposed in openings 76 of strip 14 and wires 18 are secured between teeth 72, 74 of strip 14. When block 16 is fully inserted in strip 14, sides 88 and 90 of block 16 will snap back inwardly and protrusions 78 of strip 14 will be retained in openings 98 of block 16.

Still referring to FIG. 6 and also to FIGS. 2A–D and 3A–D, when securing mounting strip 14 in base 10, arms 56 and 58 of strip 14 are urged inwardly by the inner tapered surfaces 54 of the ends 28, 30 as mounting strip 14 is pushed downwardly into channel 22 of base 10. Arms 56 and 58 will snap back outwardly from respective ends 60, 62 and retaining edges 64 will engage surfaces 100 in apertures 36 of base 10 when strip 14 is fully inserted. Strip 14 has a downwardly extending member 102 which has a planar surface 104. Surface 100 comes into contact with the upper surface of the lower portion 32 of base 10 when strip 14 is fully inserted. It will be appreciated that the distance between surface 104 and retaining edge 64 of strip 14 is generally equal to the distance between the upper surface of the lower portion 32 and surface 100 of base 10.

As mentioned, base 10 may be secured by double sided tape 44 on a surface such as the interior surface of a standard cover plate employing modular jacks. However, it is preferred that the features of base 10 be directly incorporated (e.g. molded) into a cover plate or housing which retains one or more modular jacks. For example, referring now to FIGS. 7A–D, a dual jack cover plate 106 is shown with a single modular jack 20' mounted thereto. A pair of base mounting means 108 and 110 are incorporated into the rear surface 112 of plate 106. Bases 108 and 110 are of the same type and each is substantially similar to base 10 described hereinabove. Accordingly, common elements are denoted by prime numbers. Sides 114, 116, ends 118, 120 and a portion of surface 112 form a channel 22'. Ends 118, 120 have an inverted U-shape and together with surface 112 define an aperture 36' at each end.

Sides 114, 116 extend normally from surface 112 and comprise three protruding elements 50' and a tab 52' extending upwardly at each end. A plurality of ribs 122 on surface 112 between sides 114 and 116 provide support of strip 14' when it is fully inserted. Strip 14' of assembly 12' is secured in base 108 in the same manner described hereinbefore.

Mounting bases 108 and 110 are located on surface 112 with each mounting base being positioned directly above a corresponding opening 124, 125. Assembly 12' (described hereinbefore) is shown with mounting strip 14' connected to base 108 and with modular jack 20' secured in opening 124 by a panel yoke 126. Panel yoke 126 may be of the type described in U.S. Ser. No. 566,126 filed Aug. 10, 1990, which is assigned to the assignee hereof and fully incorporated herein by reference. Plate 106 further includes a front surface 128 opposed to rear surface 112 and having a pair of countersunk mounting holes 129 therethrough. Also, the edges 130 of surface 128 are chamfered. It will be appreciated that opening 125 is also intended to have a modular jack 127 located therein, as is shown in FIGS. 8A–D.

Referring to FIGS. 9A–D, a dual side-by-side jack cover plate 131 is shown with a single modular jack 20' therein. A pair of base mounting means 132 and 134 are incorporated into the rear surface 135 of plate 131. Bases 132 and 134 are of the same type and each is similar to base 10 described hereinbefore so that common elements are again denoted by prime numbers. Base 132 comprises sides 136, 138, ends 140, 142 and a portion of surface 136 which form a channel 22'. Ends 140, 142 have an inverted U-shape and together with surface 135 define an aperture at each end.

Sides 136, 138 extend normally from surface 135 and comprise three protruding elements 50' and a tab 52' extending upwardly at each end. Strip 14' of assembly 12' is secured in base 132 in the same manner described hereinbefore.

Mounting bases 132 and 134 are located on surface 135 in a side-by-side configuration with each mounting base being positioned directly above a corresponding opening 144, 146. Assembly 12' (described hereinbefore) is shown with mounting strip 14° connected to base 134 and with modular jack 20' secured in opening 146 by a second type panel yoke 148 having a sliding door 150. Panel yoke 148 may be of the type described in aforementioned U.S. Ser. No. 566,126. Plate 131 further includes a front surface 151 opposed to rear surface 135 and having a pair of countersunk mounting holes 152. Also, the edges 153 of plate 131 extended generally downward from surface 151. It will be appreciated that opening 144 is also intended to have a modular jack located therein.

Referring now to FIGS. 10A–D, a quad jack plate 154 is shown with four modular jacks 155, 156, 158 and 160 therein. A first dual jack assembly 162 comprises a dual panel yoke 164 which has base mounting means 166, 168 incorporated therein and wire termination assemblies 170, 172 attached thereto. A second dual jack assembly 174 comprises a dual panel yoke 176 which has base mounting means 178, 180 incorporated therein and wire termination assemblies 182, 184 attached thereto. It will be appreciated that jack assemblies 162 and 174 are of the same type. Referring also to FIGS. 11A–D, dual jack assembly 162 is shown. Each wire termination assembly 170, 172 comprises a mounting strip 14' which is connected to a termination block 16' at one end with a plurality of wires 18' connected between block 16' and modular jack 155, 156, respectively. Each mounting strip 14' is snap locked into its corresponding base 166, 168. A pair of recesses 186 in the front surface 190 of yoke 164 are located directly above each jack 155, 156. Recesses 186 each have an insert 187 snap lockedly secured therein. Inserts 187 include a symbol or are otherwise marked to provide identification of each corresponding jack. Dual jack assembly 162 further includes a rear cover 188, as is only shown in FIG. 11B. Cover 188 has been omitted from the other views in order to show the details of the underlying structure. However, it is preferred that each dual jack assembly of the present invention include a cover 188. The details of cover 188 will be described with the reference to FIGS. 15A–D hereinafter.

It will be appreciated that yokes 164 and 176 are of the same type with yoke 164 being shown in detail in FIGS. 12A–G. Yoke 164 includes a front cover 192 having opposing surfaces 193, 194 and first opposing sides 195, 196 and second opposing sides 197, 198. Cover 192 includes a first opposed pair of chamfered edges 199,200 defining a first aperture 202 and a second opposed pairs of chamfered edges 204, 206 defining a second aperture 208. Above each aperture 202, 208 on surface 193 is recess 186 which is receptive to insert 187 for designation of the telecommunications outlet. An aperture 209 is located at each of the four corners of each recess 186. An extension 210 of recess 186 is provided to facilitate removal of insert 187. An insert 187 is shown in only one of recesses 186 for purposes of illustration. Cover 192 further includes a pair of channels 211 at opposing sides of cover 192. A pair of opposed resiliently defeatable cantilevered arms 214 extend forwardly from the back of sides 197 and 198 of yoke 164. Arms 214 each include a retaining edge 216 and a channel 217. Arms 214 are urged inwardly when yoke 164 is inserted into aperture 218 (FIGS. 13A and B) from the front surface 220 of plate 154 and snap back when yoke 164 is fully inserted. Plate 154 is generally rectangular and includes apertures 218 and 222 for providing access to jack assemblies 162 and 174, respectively. Yoke 164 may be removed from plate 154 by inserting a rigid member (not shown) between plate 154 and yoke 164 at each channel 211. The member is then further inserted into channel 217 of each arm 214 and urged inwardly until retaining edges 216 are released from plate 154. Yoke 164 may then be removed from plate 154. Ridges or tabs 228, 230 on surface 194 and a dividing member 233 provide alignment of jacks 155, 156. Jacks 155, 156 are secured in yoke 164 by the downward force exerted by each strip 14' when inserted in each corresponding base mounting means 166 and 168.

Base mounting means 166 and 168 depend from sides 195 and 196, respectively. Bases 166 and 168 are of the same type and each is similar to base 10 described hereinbefore wherein common elements are denoted by prime numbers. Base 166 comprises side 234 and ends 236, 238 which together form a channel 22'. Ends 236, 238 actually depend from sides 198 and 197, respectively. An aperture 239 corresponding to each end 236, 238 extends through sides 198 and 197.

Still referring to FIGS. 12A–G, side 234 depends from side 196 and comprise three protruding elements 50'. A tab 52' extends normally from sides 197 and 198 at each end opposite side 234. Strip 14' of assembly 12' is secured in base 108 in the same manner described hereinbefore. Mounting bases 166 and 168 are located at opposing sides of yoke 164. Sides 197 and 198 each include an opening 240 for engaging cover 188. Side 196 includes a groove 241 which exposes a portion of base mounting means 168. Side 195 is a continuous surface.

Figure 13A:
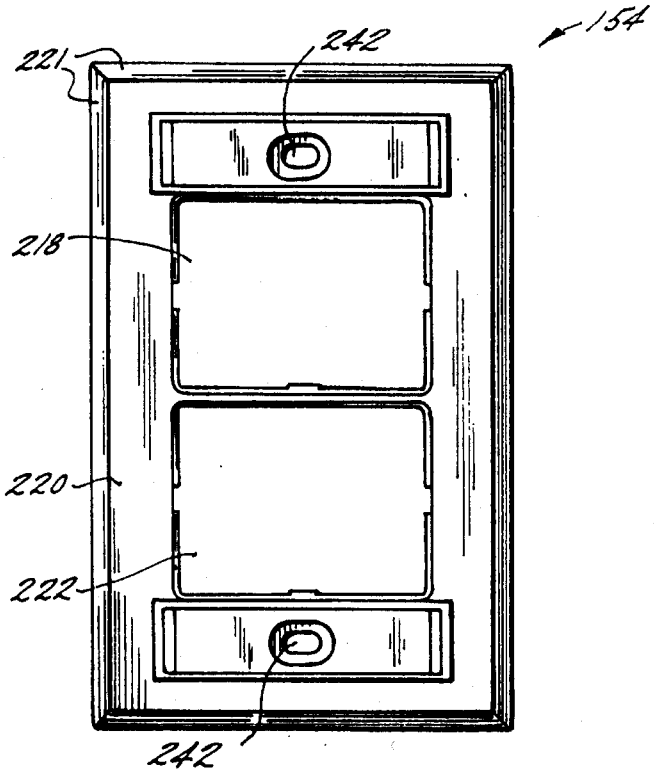
Figure 13B:
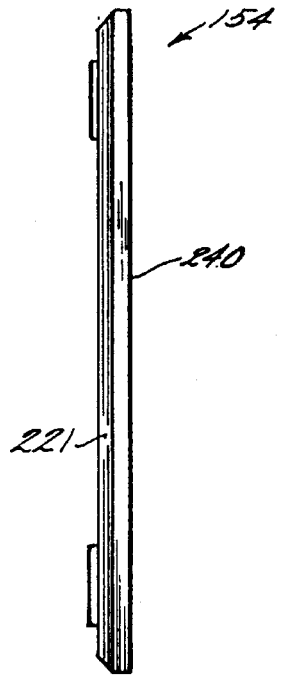
FIG. 13B is a side elevational view thereof.

Referring to FIGS. 13A and B, plate 152 includes apertures 218, 222, front surface 220, back surface 240 and a pair of mounting holes 242. The edges 221 of surface 222 are chamfered.

Referring to FIGS. 14A–D, insert 187 is shown. Insert 187 comprises a pair of opposing surfaces 244, 246 and first and second opposing sides 248, 250. The edges of surfaces 244 and 246 are chamfered. A pair of protruding elements 252 extend from each surface 250. Inserts 187 are snap lockedly inserted into recesses 186. The snap locking feature comprises the mating of elements 252 with apertures 209 of recess 186. Two lower elements 252 allow the insert to hinge in the apertures 209 to act as a door. Inserts 187 may include designations on either surface 244 or 246. A computer terminal 245 is illustrated on surface 244 (FIG. 14A) and a telephone 247 is illustrated on surface 246 by way of example. It will be appreciated that any designation symbol or term may be molded into or imprinted on these surfaces as will be dictated by the application thereof. Inserts 187 may be removed by inserting a rigid member (not shown) between insert 187 and cover 192 at extension 210. The member is urged outwardly until elements 252 are released from apertures 209. Insert 187 may then be removed from yoke 164.

Referring to FIGS. 15A–D, rear cover 188 is shown. Cover 188 comprises a generally rectangular member 254 having a resiliently defeatable arm 256 extending downwardly from each corner, opposing resiliently defeatable side panels 258 and opposing sides 260. Each arm 256 includes a protruding element 262 at one end thereof. Further, each side 258 includes a protruding element 264 at one end thereof. Member 254 has two apertures 266 which are covered by U-shaped members 268. Each member 268 includes an opening 270. Cover 188 is secured on yoke 164 by urging sides 258 inwardly until elements 264 engage openings 240 (FIG. 11B) whereby sides 258 snap back. At the same time, arms 256 are being urged inwardly until elements 262 engage the opening between each corresponding side of strip 14' and adjacent resilient arm of each assembly 12' in the dual jack assembly. Cover 188 can be removed by urging sides 258 and arms 256 inwardly until elements 264 and 262 are released.

Figure 16:
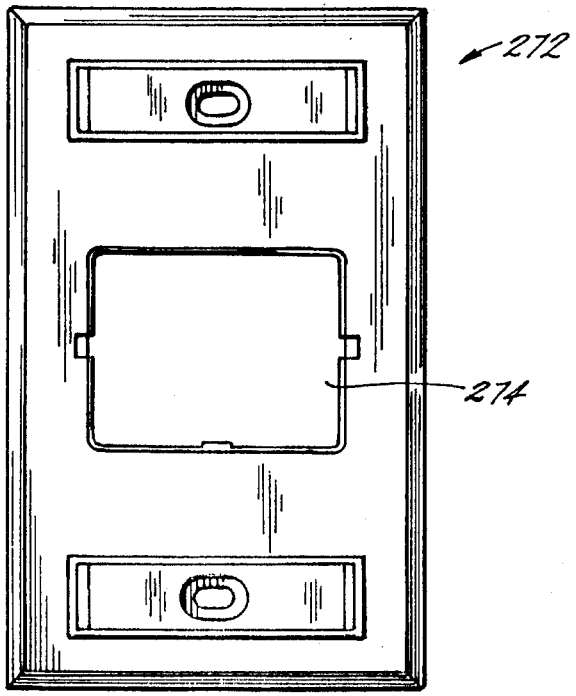
FIG. 16 is a front view of a cover plate for use with one dual modular jack assembly of FIGS. 11A–D.
Figure 14A:
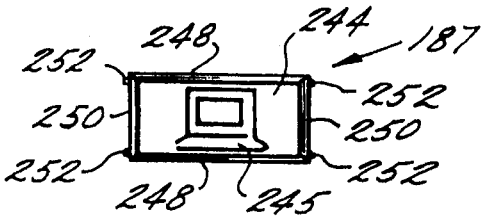
Figure 14B:
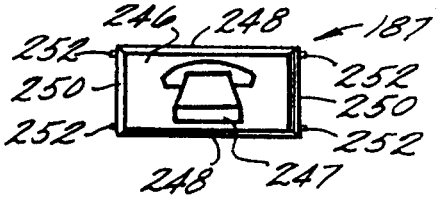
Figure 14C:
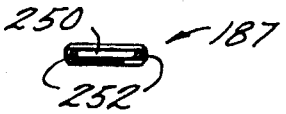
Figure 14D:
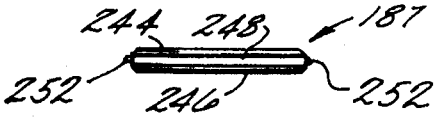
Figure 15A:
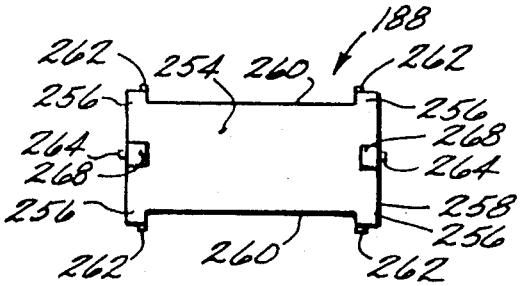
Figure 15B:
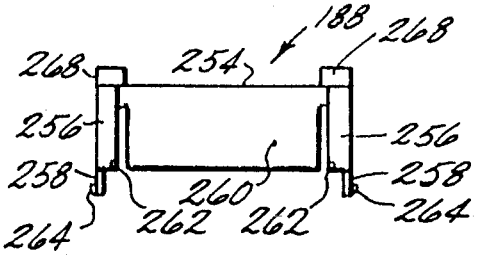
Figure 15C:
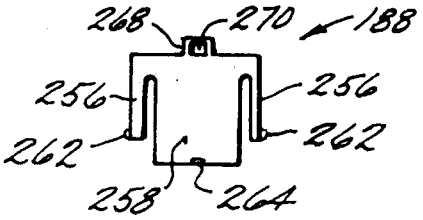
Figure 15D:
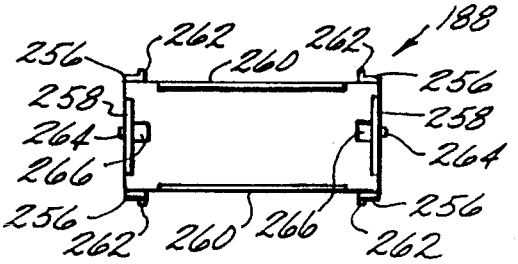
Figure 17:
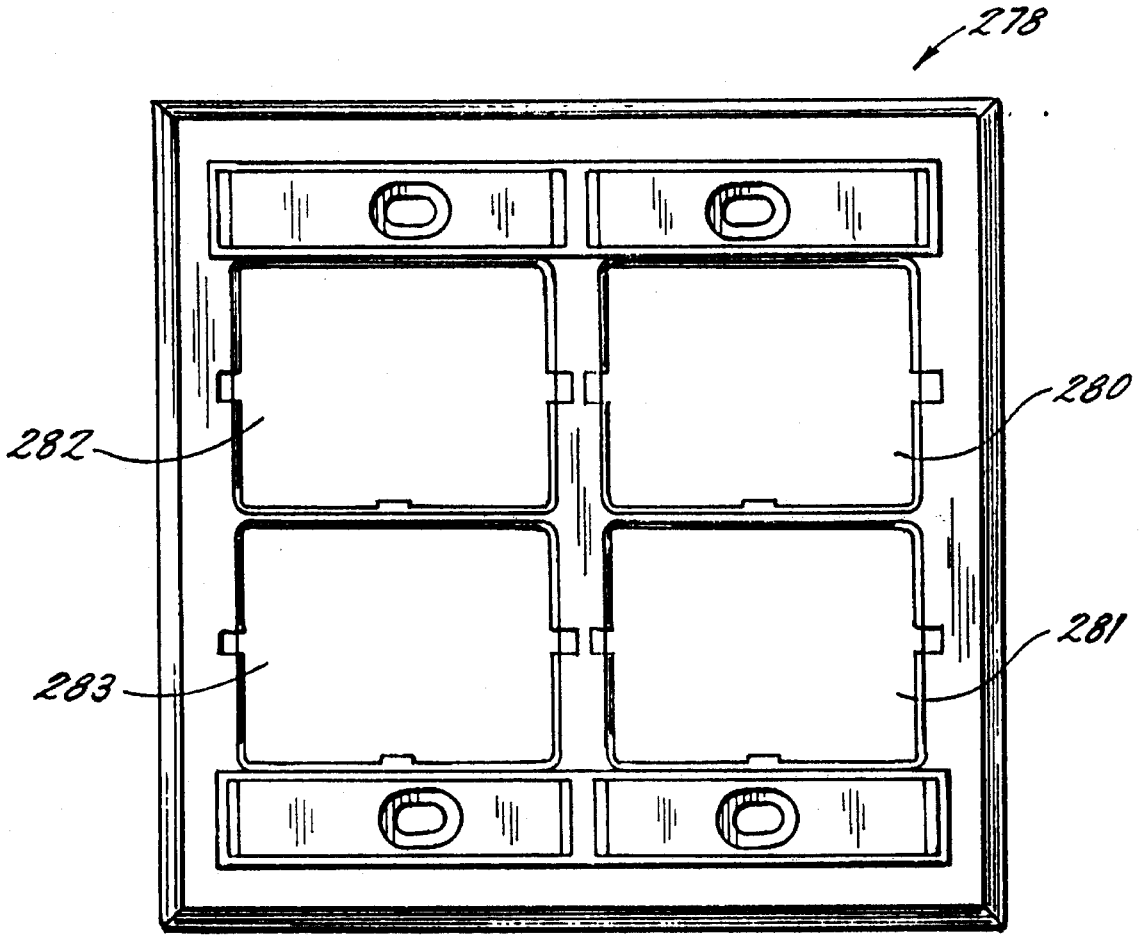
FIG. 17 is a front view of a cover plate for use with four dual modular jack assemblies of FIGS. 11A–D.

Referring to FIG. 16, a plate 272 having an aperture 274 for mounting a dual jack assembly (FIGS. 11A–D) therein is shown. Referring to FIG. 17, a plate 278 having apertures 280–283 for mounting four corresponding jack assemblies (FIGS. 11A–D) therein is shown. It will be appreciated that a plate may provide any number of apertures for mounting a corresponding number of dual jack assemblies. Further, while a dual jack assembly is preferred, a single jack assembly may be employed without departing from the spirit or scope of the present invention.

While preferred embodiments have been shown and described, various modifications and substitutions may be made thereto without departing from the spirit and scope of the invention. Accordingly, it is to be understood that the present invention has been described by way of illustrations and not limitations.

What is claimed is:

1. An apparatus for removably securing a wire connector comprising:

(1) mounting strip means, said mounting strip means including;

(a) a generally rectangular member having first and second pairs of opposing surfaces;

(b) a first plurality of spaced apart teeth extending upwardly from one of said first surfaces, said first teeth defining a first plurality of wire retaining slots therebetween, each of said first teeth having a first channel in at least one side of said first teeth, said first channels in adjacent said first teeth cooperate to define a first plurality of openings;

(c) at least one resilient arm depending downwardly relative to said rectangular member; and (d) a retaining edge disposed at one end of said arm; and (2) mounting base means, said mounting base means including;

(a) a generally rectangular member having a third pair of opposing surfaces;

(b) a first end being normally disposed on one of said third surfaces, said first end having an inverted U-shape, said first end and one of said third surfaces defining a first aperture;

(c) a second end being normally disposed on one of said third surfaces and being in alignment with said first end, said second end having an inverted U-shape, said second end and one of said third surfaces defining a second aperture, at least one of said first and second apertures having said retaining edge disposed therein; and (d) at least one side being normally disposed on one of said third surfaces and being disposed between said first and second ends for defining a second channel therebetween.

2. The apparatus of claim 1 further comprising:

said mounting strip means having at least one third channel in at least one of said second surfaces; and said mounting base having at least one protruding element extending normally upward from an upper surface of said side, said protruding element being disposed in said third channel.

3. The apparatus of claim 1 further comprising:

termination block means, said termination block means including;

(a) a housing having first and second spaced apart sidewalls and opposed upper and lower ends, said housing having second openings extending through said upper and lower ends;

(b) a plurality of spaced apart insulation penetrating beam contacts disposed in said second openings of said housing, said beam contacts extending between said upper and lower ends, said beam contacts at said lower end disposed in said first openings between said first teeth of said mounting strip; and (c) a second plurality of spaced apart teeth defining second wire conductor retaining slots.

4. The apparatus of claim 3 further comprising:

a plurality of wire conductors, one end of said wire conductors being connected to said beam contacts at said lower end of said housing; and a modular jack, said modular jack being connected to the other end of said wire conductors.

5. The apparatus of claim 3 further comprising:

said mounting strip means having a protruding element disposed on at least one side of at least one of said first teeth; and said termination block means having at least one third opening in at least one of said first and second sidewalls, said third opening having said protruding element disposed therein.

* * * * *